United States Patent [19]

Casull

[11] 4,391,058

[45] Jul. 5, 1983

[54] TRIGGER AND FIRING MECHANISM FOR BOLT ACTION RIFLE

[76] Inventor: Richard J. Casull, P. O. Box 276, Freedon, Wyo. 83120

[21] Appl. No.: 224,183

[22] Filed: Jan. 12, 1981

[51] Int. Cl.[3] ..... F41C 19/00; F41C 17/02

[52] U.S. Cl. ..... 42/69 A; 42/70 E

[58] Field of Search ..... 42/69 A, 70 E, 69 R

[56] References Cited

U.S. PATENT DOCUMENTS

| | | | |
|---|---|---|---|
| Re. 26,872 | 4/1970 | Dieckmann | 42/70 E |
| 2,406,493 | 8/1946 | Dunn | 42/69 A |
| 3,225,657 | 12/1965 | Kruzell | 42/69 A X |
| 3,680,241 | 8/1972 | Ramsay | 42/69 R |
| 4,300,301 | 11/1981 | Morrison | 42/70 E |

*Primary Examiner*—Charles T. Jordan
*Assistant Examiner*—Ted L. Parr
*Attorney, Agent, or Firm*—Terry M. Crellin; B. Deon Criddle

[57] ABSTRACT

A bolt action firearm having novel trigger and firing mechanism associated with the bolt. A firing pin is located in a bore extending from the head end of the bolt a distance slightly greater than the length of the firing pin. A cammed notch extending from the longitudinal side of the bolt, intersects the inward end of the first bore. A trigger mechanism is provided having a spring-loaded puncher member adapted to slide longitudinally upward in the cammed notch to strike the inner end of the firing pin. Upon movement of the bolt in ejecting a spent casing from the firearm, the cammed notch forces the puncher downward and the trigger mechanism engages the puncher holding it in its spring-loaded position so that the firearm is ready to be fired again.

5 Claims, 5 Drawing Figures

TRIGGER AND FIRING MECHANISM FOR BOLT ACTION RIFLE

BACKGROUND OF THE INVENTION

1. Field

This invention relates to bolt action type firearms and, in particular, to improved firing mechanisms for such firearms.

2. State of the Art

Bolt action rifles conventionally have a complex bolt mechanism including a firing pin positioned within a longitudinal chamber or bore in the bolt. A complicated mechanism requiring intricate costly machining techniques is provided to spring bias the firing pin and to cooperate with the trigger in releasing the biased firing pin to fire the rifle. In addition, the bolt has required complex means for locking the bolt securely in its firing position when the rifle is fired so that the bolt can not be ejected backwardly under the pressure developed by the firing of the shell.

3. Objectives

A principal objective of the present invention is to provide a unique, novel mechanism for firing a bolt-action type firearm. A particular objective is to provide a bolt action mechanism in which only relatively simple machining techniques are required in making the bolt and the trigger mechanism. An additional objective is to provide a reliable, simple mechanism for activating the firing pin of the bolt and which simultaneously acts as a safety lug for retaining the bolt in its firing position when the firearm is fired. A further objective is to provide a firing mechanism in which only a few of the parts require heat treatment, thus reducing the manufacturing cost of the firing mechanism.

SUMMARY OF THE INVENTION

The above and other objectives of the present invention are achieved in a bolt action firearm in which the bolt is designed to have a longitudinal bore or chamber extending from the head end of the bolt and adapted to receive an elongate firing pin therein. A cammed notch is formed in the side of the bolt so as to intersect the innermost end of the bore in which the firing pin is positioned. An opening is provided in the receiver so as to be in alignment with the cammed notch in the bolt when the bolt is in its closed, ready-to-fire position.

A spring-biased puncher is adapted to move longitudinally within the opening in the receiver from a cocked position in which the head or lead end of the puncher is substantially withdrawn from the cammed notch to a fired position in which the head or lead end of the puncher enters into the cammed notch in the bolt so as to strike the rear end of the firing pin. The cammed notch in the bolt is adapted to push the puncher from the cammed notch to the puncher's cocked position when the bolt moves in its function of extracting a spent shell casing from the firearm. Novel trigger means are provided for engaging the puncher in its cocked position and releasing the puncher when the trigger is pulled. When the cocked, spring-biased puncher is released, it moves into the cammed notch and strikes the inner end of the firing pin, and the firing pin is, in turn, forced forward so as to strike the end of the cartridge in the firing chamber of the firearm. The puncher is retained in its position extending through the opening in the receiver and into the cammed notch in the bolt as the shell in the firearm is fired, and the puncher thereby acts as a positive safety lug mechanism for retaining the bolt in its position within the receiver during the firing of the firearm.

Additional objects and features of the invention will become apparent from the following detailed description taken together with the accompanying drawings.

THE DRAWINGS

An embodiment representing the best mode presently contemplated of carrying out the invention is illustrated in the accompanying drawings, in which.

DETAILED DESCRIPTION OF THE ILLUSTRATED EMBODIMENT

Figures 1, 2, 3, 4, 5:
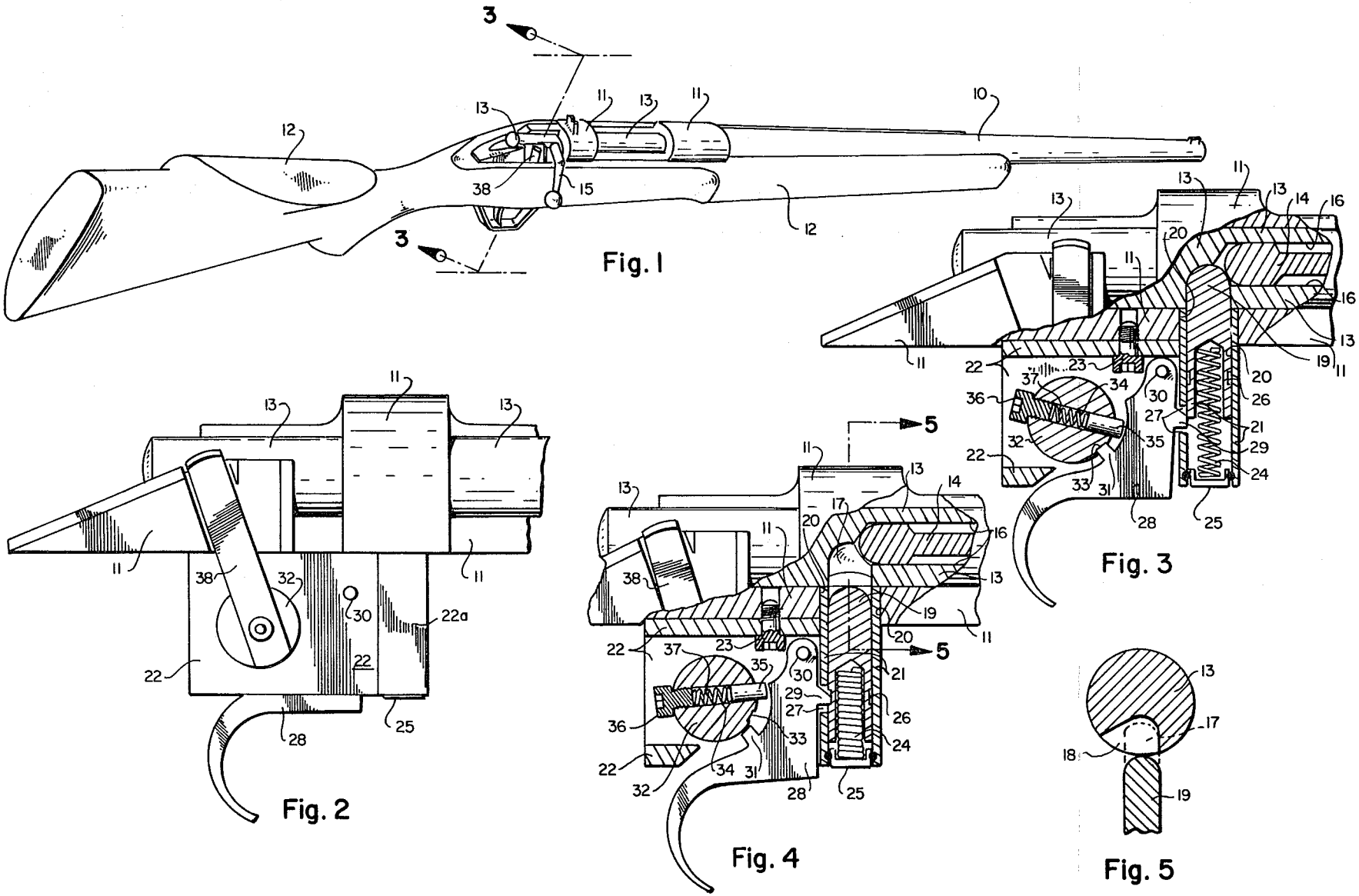
FIG. 1 is a pictorial view of a bolt action type rifle in accordance with the present invention.
FIG. 2 is a partial elevation taken along line 3–3 of FIG. 1 and showing the rear end of the receiver and the trigger mechanism attached thereto.
FIG. 3 is a partial elevation similar to that of FIG. 2 showing the trigger mechanism and a portion of the receiver and bolt in cross-section, with the triggering mechanism in the fired position.
FIG. 4 is a view similar to that of FIG. 3 with the triggering mechanism in the cocked, ready-to-fire position.
FIG. 5 is a cross-sectional view taken along line 5—5 of FIG. 4 showing the puncher and bolt with other portions of the mechanism deleted.

In a preferred embodiment of the invention as illustrated in the drawings, a bolt action rifle is provided having an elongate barrel 10 and an action or receiver 11 attached to the rear end or base end of the barrel 10. The receiver 11 and barrel 10 are mounted on a gun stock 12.

As conventional in a bolt action rifle, a bolt 13 is received in a bore in the receiver 11. A firing pin 14 is positioned within a longitudinal bore in the bolt 13, with the bolt 13 being movable from a retracted position not shown in the drawings to a closed or ready-to-fire position as shown in FIG. 1. For purposes of moving the bolt 13, a bolt lever 15 is provided on the bolt as customary. The lever 15 has been omitted from FIGS. 2–5 for clarity in showing elements of the triggering mechanism which would otherwise be obscured beneath the lever.

In accordance with the present invention, a unique, improved firing mechanism is provided for the bolt action rifle. The bolt 13 is provided with a longitudinal bore 16 extending from the head end of the bolt 13. An elongate firing pin 14 is positioned in the bore 16 of bolt 13. The forward end (not shown in the drawings) of the firing pin 14 is adapted to project from the forward end of the bolt 13 as is well known in the art to strike the end of a cartridge in the firing chamber of the rifle when the bolt 13 is in its closed or ready-to-fire position. A particularly advantageous embodiment of a firing pin and bolt mechanism is shown and described in my copending patent application, Ser. No. 224,092 which is entitled Bolt Mechanism and Receiver for Bolt Action Rifle and was filed concurrently with this application. The entire contents of the aforementioned copending application are incorporated herein by reference.

As illustrated, a cammed notch 17, best shown in FIGS. 4 and 5, extends inwardly from the longitudinal side of the bolt 13 and intersects the innermost end of the longitudinal bore 16 in the bolt 13. The term "cammed notch" is meant to include any arrangement of a hole, well, or bore extending from the side of the bolt 13 with a portion of the sidewall of the opening or bore being reamed out to form a slanting, cam surface 18 best shown in FIG. 5. As will be described in more detail hereinafter, the cam surface is adapted to push against a puncher element 19 as the bolt 13 is rotated during the extraction of a spent shell casing from the rifle.

An opening 20 (FIGS. 3 and 4) in the lower side wall of the receiver 11 is adapted to be in alignment with the cammed notch 17 in the bolt 13 when the bolt 13 is moved to its closed or ready-to-fire position. A spring-biased puncher 19 is adapted to move longitudinally within the opening 20. Preferably, a guiding, sleeve member 21 extends from the opening 20 in the receiver 11, and the puncher 19 moves longitudinally within the sleeve member 21. As illustrated, the sleeve member 21 is advantageously connected to the opening 20 by a tight compression fit of one end of the sleeve member 21 into the opening 20. Further a housing member 22 is adapted to enclose the upper portion of the trigger mechanism and is attached to the receiver 11 by a screw 23 (FIG. 4). The housing 22 has a cylindrical section **22*a* (FIG. 2) which fits tightly around the sleeve member 21 and, thus, also aids in mounting the sleeve member 21 securely to the receiver 11**.

The puncher 19 is mounted inside the sleeve member 21 and is adapted to move from a cocked position as shown in FIG. 4 in which the head end of the puncher 19 is substantially withdrawn from the cammed notch 17 to a fired position as shown in FIG. 3 in which the lead end of the puncher 19 enters into the cammed notch 17 and strikes the rear end of the firing pin 14. The puncher 19 is biased into its fired position by a coiled compression spring 24. A cap 25 is provided at the free end of the sleeve member 21 and the spring 24 is positioned between the puncher 19 and the cap 25 so as to force the puncher 19 towards its fired position.

As mentioned above, the cam surface 18 of the cammed notch 17 is adapted to push the puncher 19 downward into its cocked position when the bolt 13 is rotated in the conventional movement of the bolt during operation of a bolt type rifle in extracting a spent cartridge from the rifle and replacing it with an unfired cartridge. As the bolt 13 is rotated by moving the bolt lever arm 15, the cam surface 18 of the cammed notch 17 engages the generally rounded end of the puncher 19 and pushes the puncher 19 downwardly in the sleeve member 21 against the coil spring 24.

The puncher 19 has a recess 26 circumscribing its perimeter and intermediate its ends. The sleeve member has an opening 27 which is adapted to make aligned engagement with the recess 26 in the puncher 19 as the puncher 19 is forced downwardly to its cocked position. A trigger means 28 is provided having a sear pin 29 thereon adapted to engage the recess 26 in the puncher 19 when the puncher is moved to its cocked position. The sear pin 29 retains the puncher 19 in its cocked, ready-to-fire position until the trigger 28 is pulled so as to release the puncher. As is customary, the trigger means is spring biased so that the sear pin 29 automatically engages the recess in the puncher 19 as the puncher is moved downwardly to its cocked position by the motion of the bolt 13. The puncher 19 is thus retained in its cocked position as the motion of the bolt 13 is completed in retracting a spent shell from the rifle and positioning a new shell in the rifle. When the new shell has been positioned and the bolt 13 is again in its closed, ready-to-fire position, the cammed notch 17 is in alignment with the puncher 19. To fire the rifle, the trigger 28 is pulled so as to release the sear pin 29 from the recess 26 in the puncher 19, and the puncher 19 is biased by the spring 24 to move into the cammed notch 17 and strike the firing pin 14. Preferably, the inner end of the firing pin 14 has a rounded surface which is contacted by the rounded end of the puncher 19. The firing pin 14 is then driven forward so as to fire the rifle.

The upper end of the trigger means 28 is preferably pivotally mounted adjacent to the sleeve member 21 at the upper side of the housing 22. As shown, the trigger 28 is mounted on a pivot pin 30 which extends through the housing 22 such that the trigger can be pivoted away from the sleeve member 21 sufficiently that the sear pin 29 will be withdrawn from the recess in the puncher 19. Means are provided for spring biasing the trigger to pivot towards the puncher 19 and thus to automatically engage the puncher 19 in its cocked position. As shown, the side of the trigger means 28 away from the sleeve member 21 has a generally circular cam surface with a stop lug 31 projecting therefrom. A cylindrical safety 32 is mounted behind the trigger means and is adapted to rotate about its cylindrical axis. The safety 32 has a notch 33 (best seen in FIG. 4) which is adapted to receive the stop lug 31 of the trigger 28 when the safety 32 is in its off position so that the rifle can be fired. When the safety is rotated to its on position as shown in FIG. 4, the stop lug 31 abuts the cylindrical surface of the safety 32 and the trigger cannot be pulled.

The spring biasing means for the trigger 28 is advantageously incorporated into the safety member 32. As illustrated, the cylindrical safety member 32 has a bore 34 therethrough and a spring-biased pin 35 slidably positioned within the bore 34, with one end of the spring-biased pin 35 extending from the bore 34 and engaging the circular cam surface of the trigger 28. A screw 36 is threaded into the other end of the bore 34, and a coil spring 37 is positioned in the bore 34 between the screw 36 and pin 35. A lever 38 is attached to the outer end portion of the cylindrical safety 32 and extends upwardly along the housing 22 and receiver 11 as shown in FIG. 2. The end of the lever 38 extends upward from the stock 12 as shown in FIG. 1 when the receiver is mounted in the stock so that the lever 38 can be moved back and forth to move the safety 32 between its on and off positions.

The novel, unique firing mechanism of the present invention comprises parts which are readily and relatively inexpensively made. The parts which require heat treatment are minimized. In addition, those parts are easily heat treated and are of such shape and nature that rejection due to warpage during the heat treatment is also minimized. Instead of such large components such as the entire receiver and bolt requiring heat treatment, only the firing pin 14, puncher 19, and sleeve member 21 must be heat treated, and these parts are small and easily treated with minimum cost and little to no rejection of such parts due to warpage during heat treatment. In addition to working in combination with the trigger and firing pin in firing the firearm, the puncher 19 simultaneously acts as a safety lug for retaining the bolt in the receiver when the firearm is fired. The puncher 19 enters the cammed notch 17 in the bolt 13 a split second prior to the actual firing of the cartridge in the firearm, and the puncher 19, thus, acts like a shear pin in retaining the bolt 13 in the receiver against the the pressure developed by the firing of the shell or cartridge. When the puncher 19 is engaged in the cammed notch 17, the bolt 13 cannot move longitudinally within the receiver without shearing the puncher 19, and the force to shear the puncher 19 is much greater than the force exerted by the back pressure developed by the firing of the shell or cartridge. Thus, the puncher 19 becomes a positive, safety lock which prevents dangerous back firing of the bolt 13. After the firearm has been fired, the puncher 19 is pushed from the cammed notch 17 in the bolt 13 by the action of the cam surface 18 as the bolt 13 is moved in ejecting the spent casing from the firearm as described hereinbefore.

Although a preferred embodiment of my invention has been disclosed and illustrated herein, it is to be understood that the present disclosure is made by way of example and that variations are possible without departing from the subject matter coming within the scope of the following claims, which subject matter I regard as my invention. In particular, a single action rifle has been described in detail; however, it is to be recognized that the invention is applicable to all bolt action type firearms including single action and automatic bolt action rifles, falling block rifles, and pistols utilizing a bolt type action.

I claim:

1. In a bolt action type firearm, in which the barrel of the firearm is attached to a receiver and a bolt is received in a bore in the receiver, an improved firing mechanism comprising a longitudinal bore within the bolt extending from the head end of the bolt;

an elongate firing pin positioned in said longitudinal bore, with the forward end of the pin adapated to project from the forward end of the bolt to strike the end of a cartridge in the firing chamber of the firearm when the bolt is in its closed position, and with the rear end of the firing pin positioned near the innermost end of the longitudinal bore in said bolt;

a cammed notch in the bolt extending inwardly from a longitudinal side of the bolt and intersecting the innermost end of the longitudinal bore in said bolt;

an opening in the receiver adapted to be in alignment with the cammed notch in the bolt when the bolt is in its closed position;

an elongate spring-biased puncher having a recess in its side surface, said puncher being adapted to move lengthwise within the opening from a cocked position in which the lead end of the puncher is substantially withdrawn from the cammed notch to a fired position in which the lead end of the puncher enters into the cammed notch in the bolt so as to strike the rear end of the firing pin, with said cammed surface on the cammed notch being adapted to push the puncher from the cammed notch in the bolt to the puncher's cocked position during movement of the bolt to extract a spent shell casing from the firearm;

trigger means having a sear pin thereon adapted to engage the recess in the spring-loaded puncher when the puncher is moved into its cocked position, whereby the puncher is retained in its cocked position until the trigger is pulled so as to move the sear pin from the recess in said puncher, whereupon the puncher moves into the cammed notch in the bolt and strikes the firing pin and the firing pin is, in turn, forced forward so as to strike the end of the cartridge in the firing chamber of the firearm.

2. A bolt action type firearm in accordance with claim 1, wherein a sleeve member extends from the opening in the receiver and the spring-biased puncher moves lengthwise within the sleeve member, with the sleeve member having an opening therein through which the sear pin of the trigger extends so as to engage the recess in the puncher.

3. A bolt action type firearm in accordance with claim 2, wherein the end of the sleeve member away from the receiver is provided with a cap member and a spring is provided between the puncher in said sleeve member and the cap member to bias the puncher.

4. A bolt action type firearm in accordance with claim 2, wherein the trigger means is pivotally mounted adjacent to the sleeve member so as to pivot away from the sleeve member, with the side of the trigger means away from the sleeve member having a circular cam surface with a stop lug projecting therefrom, and a cylindrical safety is mounted behind the trigger means, said safety having a notch therein to receive the stop lug of the trigger when the safety is in the off position, said cylindrical safety being adapted to be rotated to a safety on position in which the stop lug strikes the cylindrical surface of the safety and the trigger cannot be pulled.

5. A bolt action type firearm in accordance with claim 4, wherein the cylindrical safety has a bore therein, with a spring biased pin slidably extending from the bore in the safety to engage the circular cam surface of the trigger means and bias the trigger means to pivot towards the sleeve member.

* * * * *